US006311884B1

(12) United States Patent
Johnson

(10) Patent No.: US 6,311,884 B1
(45) Date of Patent: Nov. 6, 2001

(54) DUAL STRAP SYSTEM FOR CONVERSION OF BAGS TO BACKPACKS

(76) Inventor: Justin Johnson, 2107 Hidden Woods Ct., Arlington, TX (US) 76006

( * ) Notice: Subject to any disclaimer, the term of this patent is extended or adjusted under 35 U.S.C. 154(b) by 0 days.

(21) Appl. No.: 09/611,331

(22) Filed: Jul. 6, 2000

Related U.S. Application Data

(63) Continuation-in-part of application No. 09/432,375, filed on Nov. 1, 1999, now abandoned.

(51) Int. Cl.[7] ..... A45F 3/04
(52) U.S. Cl. ..... 224/627; 224/153; 224/637
(58) Field of Search ..... 224/153, 578, 224/579, 580, 627, 606, 637, 645, 259, 260, 262

(56) References Cited

U.S. PATENT DOCUMENTS 2,149,803 * 3/1939 Wight .
3,152,738 * 10/1964 Worsfold, Jr. .
3,346,155 * 10/1967 Oechsle .
5,497,923 * 3/1996 Pearson et al. .
5,639,004 * 6/1997 Carlton et al. ..... 224/579
5,957,354 * 9/1999 Mentken ..... 224/627 X
6,152,342 * 11/2000 Suk ..... 224/645

* cited by examiner

*Primary Examiner*—Gregory M. Vidovich
(74) *Attorney, Agent, or Firm*—George L. Williamson

(57) ABSTRACT

The present invention discloses a dual strap system used for connection to a utility bag, such as a computer bag, by which the bag can be converted into a backpack, In a first embodiment, the dual straps of the system cross each other by means of a rigid member disposed at the crossing point to provide a twist resistant arrangement and properly center the present invention on the back of the user. One strap has a stop located thereon which helps position the straps with respect to the rigid member when the strap is off the bag and maintain the integrity of the device during the time the device is not installed on the bag. An attachment clip system is also provided which automatically positions the straps properly for use when the right hand grab technique is used to shoulder the device. Further, the clip system is designed to keep the straps from tangling when the device is off the bag. In a second embodiment, a swivel is provided for connection of the two straps which allows the rigid member to act as a cantilever-like member which helps provide a proper opening in the straps for shouldering the present invention.

18 Claims, 2 Drawing Sheets

DUAL STRAP SYSTEM FOR CONVERSION OF BAGS TO BACKPACKS

This application is a continuation-in-part of application Ser. No. 09/432,375 filed on Nov. 1, 1999 now abandoned.

BACKGROUND OF THE INVENTION

1. Field of the Invention

The present invention generally relates to strap systems for carrying utility bags manufactured with connection loops on the ends thereof, more particularly, is concerned with a dual strap system for converting utility bags to backpacks.

2. Description of the Prior Art

Strap systems and backpacks have been described in the prior art. However, none of the prior art devices disclose the unique features of the present invention.

In U.S. Pat. No. 5,429,288, dated Jul. 4, 1995, Sattler disclosed a supplemental carry strap for use with luggage, including golf bags, garment bags and the like, having a single shoulder carry strap including a padded or unpadded shoulder-contacting element having an optional positioning indicator and two connecting straps and to adjust the position of the carried luggage while retaining the shoulder element in the proper position for contacting the shoulder, and a coupling element for receiving the connecting straps and, further, having a connecting arrangement for attaching the supplemental carry strap to the luggage to be carried.

In U.S. Pat. No. 5,887,777, dated Mar. 30, 1999, Myles, et al., disclosed a protective carrying bag for a computer which includes opposing front and back walls. An opening in the front wall provides access by a user for viewing a screen on the computer when the computer is contained within the bag. Opposing openable first and second side walls as well as a lower wall extend between the front and back walls. A carrying strap is included which is capable of being secured in a first arrangement for carrying the bag in a substantially vertical orientation and in a second arrangement for carrying the bag in a substantially horizontal orientation such that the computer can be operated through the opening in the front wall while being carried in the substantially horizontal orientation.

In U.S. Pat. No. 5,881,932, dated Mar. 16, 1999, Wadden disclosed a bag which is convertible between a hand-held bag, a shoulder bag and a backpack. The bag includes a bag body defining an interior storage space. A top handle is positioned on a top portion of the body. The bag includes a pair of discrete, separate shoulder straps and a pair of independently operable shoulder straps retraction systems. Each of the retraction systems includes at least one reel-type winding device operable connected to a respective strap for storing and selectively retracting and withdrawing a portion of the respective shoulder straps. Each reel-type device is positioned in the bag at least in part within the interior storage space, and overlying a respective opening in the bag to withdraw and retract the respective shoulder strap therefrom. Each strap is selectively positionable at a retracted position, a withdrawn position, and an intermediate position. Each strap is independently withdrawable from the bag from about the reel-type device to the withdrawn position to convert the bag from the hand-held bag to a shoulder bag. Both straps are independently withdrawable from and retractable into the bag to the intermediate positions, to convert the bag from the hand-held or shoulder bag to a backpack. Each strap is independently adjustable in the intermediate position to provide a snug fit of the backpack to a user's back.

In U.S. Pat. No. 4,768,689, dated Sep. 6, 1988, Davis disclosed a multi-purpose sling which includes an elongated flexible strap with a hook attached to the middle bar of a slide buckle threaded on the strap, thereby forming an adjustable loop. A second hook is attached to a ring which is threaded onto the strap in the adjustable loop. Each hook is J-shaped and large enough to freely hold the string of a compound bow.

In a second embodiment, a hook is attached to one end of a flexible strap and the strap is then threaded through a ring attached to the strap near the first hook, and then through a second ring which is loose on the strap. The other end of the strap is then fastened to the large ring to form a double loop arrangement. A second hook is connected to the loose ring. In this embodiment, the hooks are generally U-shaped with a narrow throat portion which will snap onto a ring or similar member on the item to be carried. A slot in the J-shaped hook in the first embodiment allows the J-shaped hook to be connected to the U-shaped hook.

In U.S. Pat. No. 5,131,576, dated Jul. 21, 1992, Turnipseed disclosed a backpack support device which utilizes interconnected front and back straps and a separate waist strap, the straps providing for a more even distribution of the backpack load. The support device comprises a shaped member and a padded member affixed to the surface of the shaped member in contact with the wearer's back. The shaped member of the support device, shaped to the curvature of a wearer's back, and the interconnection points of the crossing straps and the waist belt over the femur joint enable the load from the backpack to be more evenly distributed along the entire back of the wearer.

In U.S. Pat. No. 5,909,806, dated Jun. 8, 1999, Fischel, et al., disclosed a shock absorbing structure comprising a bladder having a undeformed shape and being constructed of a substantially gas impervious material. The bladders are filled with a resiliently deforming material, said material defoaming in response to an application of force upon said bladder and returning to its undeformed shape upon removal of such applied force. The bladder being in communication with an air release member, to allow for discharge of air when said force is applied upon the bladder.

In U.S. Pat. No. 5,494,157, dated Feb. 27, 1996, Golenz, et al., disclosed a case specifically designed to carry microcomputers. One type of microcomputer, the laptop style, can be carried by hand or from a shoulder strap in such cases. (Unfortunately, as these microcomputers become more powerful tools for scientists, students, engineers, artists, and medical personnel, there is an ever greater need to protect these devices while enhancing their ready access and ease of use. These two conflicting requirements, easy removal from the carrying case, and superior protection from weather and impact, have not been adequately met by these several computer cases. This computer case provides a main packing space for the microcomputer defined by a "C" shaped rigid frame and corresponding shock absorbing pad, the forth side of the packing space is selectively closed by a padded access door. The handle and/or shoulder strap is riveted to the upper side of this "C" shaped frame. The access door is integrally hinged to the lower side of the frame, and is secured to the case when closed by double slide fastener and hook and loop fasteners.

In U.S. Pat. No. 4,365,776, dated Dec. 28, 1982, Gaylord, et al., disclosed a double safety manually releasable strap connector which employs a male and a female member and latching devices to releasably connect the same, including a rotatable inter-connecting element in the female member. A manipulating lever is connected to the rotatable inter-connecting element for pivotal movement away from the female member. A first latch to prevent the pivotal movement of the lever for rotating the inter-connecting element being releasable by sliding the lever, and a second latch for locking the sleeve against the sliding movement. The male member is adapted to hold the riser of the canopy shrouds of a parachute and the female member is adapted to hold straps of the harness for the parachute.

In U.S. Pat. No. 5,038,984, dated Aug. 13, 1991, Izzo disclosed a golf bag which has a support strap assembly that allows carriage by a person. The strap assembly includes a first strap having one strap end secured to the golf bag at a first location at its upper, open end, and the other strap end is secured to the golf bag at a second location longitudinally spaced from the first location. A second strap has one end secured to the golf bag at the second location, and the other strap end is secured to the golf bag at a third location between the second location and the closed end of the golf bag. The ends secured at the second location are preferably attached to one another to form a central portion for the strap assembly. The two straps thus allow the golf bag to be carried on both shoulders and oriented transversely across the back. Various mounts are described for these two straps, and different adjustment and padding structures are disclosed.

In U.S. Pat. No. Des. 281, 120, dated Oct. 29, 1985, Rabinowitz disclosed the ornamental design for a tote bag with double strap, substantially as shown and described.

In U.S. Pat. No. 5,636,778, dated Jun. 10, 1997, Jones, et al., disclosed a double strap system for golf bags which includes a first shoulder strap having upper and lower ends attached to a generally tubular body of a golf bag at a first and second locations, respectively. In one embodiment of the double strap system, the lower end of the first shoulder strap is connected to a buckle and slide mechanism which is provided for relocating the second location in a direction that is generally parallel to a length dimension of the golf bag body. A second shoulder strap has opposite ends attached to the golf bag body at third and fourth locations that are spaced apart in another direction that is generally transverse to the body length dimension. In an alternative embodiment of the double strap system, the tower end of the first shoulder strap may be connected to either one of a pair of attachment devices mounted on the golf bag body to thereby relocate the second location.

While these strap systems and/or devices may be suitable for the purposes for which they were designed, they would not be as suitable for the purposes of the present invention, as hereinafter described.

SUMMARY OF THE INVENTION

The present invention discloses a dual strap system used for connection to a utility bag, such as a computer bag, by which the bag can be converted into a backpack. In a first embodiment, the dual straps of the system cross each other by means of a rigid member disposed at the crossing point to provide a twist resistant arrangement and properly center the present invention on the back of the user. One strap has a stop located thereon which helps position the straps with respect to the rigid member when the strap is off the bag and maintain the integrity of the device during the time the device is not installed on the bag. An attachment clip system is also provided which automatically positions the straps properly for use when the right hand grab technique is used to shoulder the device. Further, the clip system is designed to keep the straps from tangling when the device is off the bag. In a second embodiment, the dual straps of the system cross each other by means of a swivel connection disposed at the crossing point to provide a twist resistant arrangement and properly center the present invention on the back of the user. The rigid member acts as a cantilever-like member which helps provide an opening in the straps for shouldering. An attachment clip system is also provided which automatically positions the straps properly for use when the right hand grab technique is used to shoulder the device. Further, the clip system is designed to keep the straps from tangling when the device is off the bag.

An object of the present invention is to provide a strap system which can be used to convert a bag to a backpack. A further object of the present invention is to provide twist resistant behavior when the invention is on and off the bag. An additional object of the present invention is to provide a strap system which limits the straps from becoming tangled when the invention is on and off the bag. This is accomplished in the two embodiments through the rigid member, stop, swivel connection and linkage system. An additional object of the present invention is to provide a twist-resistant rigid member strap mechanism to be used with a dual strap system. An additional object of the present invention is to provide a strap system which prevents the straps from becoming tangled when not in use.

The foregoing and other objects and advantages will appear from the description to follow. In the description reference is made to the accompanying drawings, which for in a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
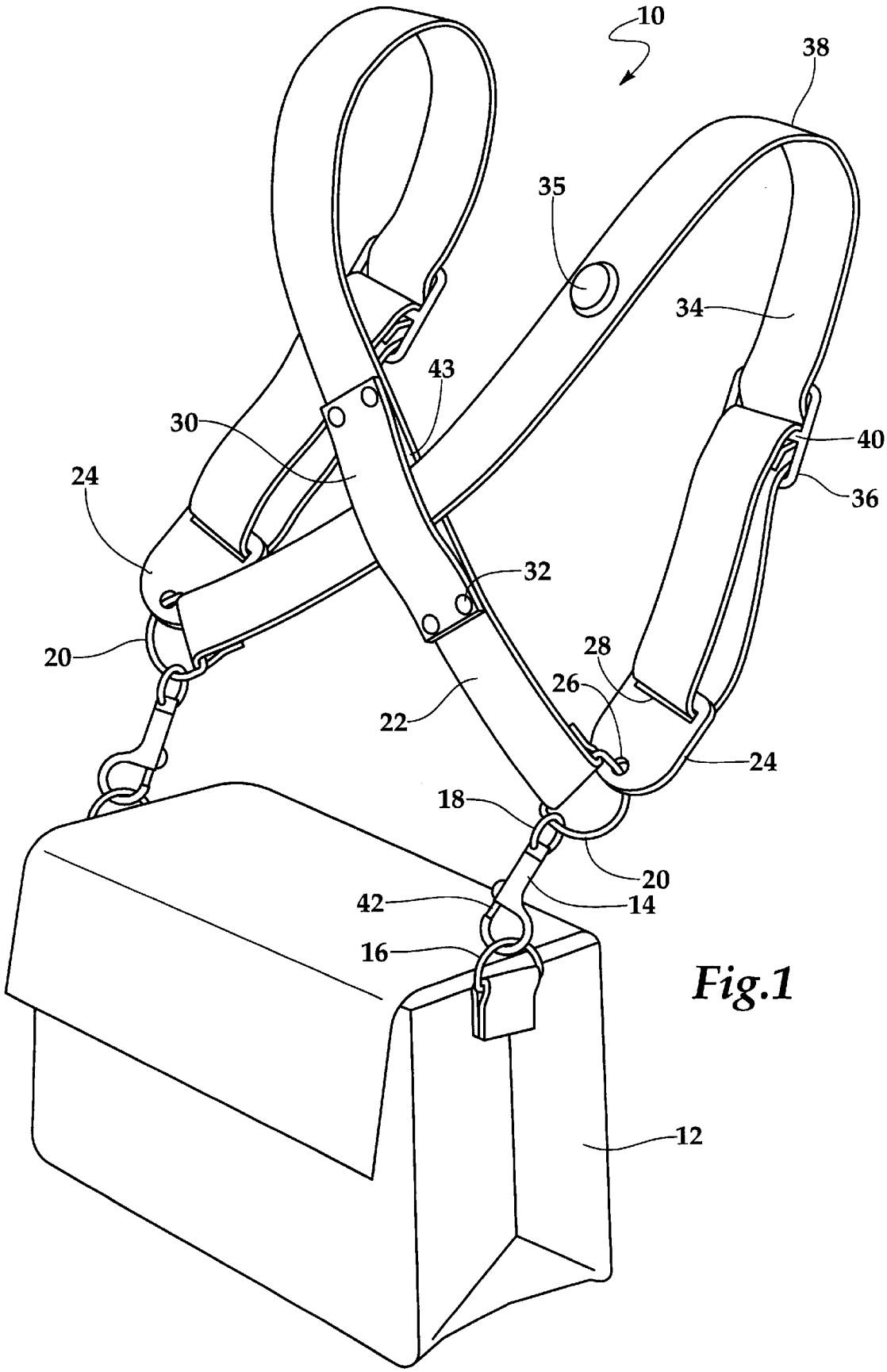
FIG. 1 is a perspective view of one embodiment of the present invention.

With regard to reference numerals used, the following numbering is used throughout.

10 present invention
12 utility bag
14 clip
16 collection means
18, 18' connecting loop
20 D loop
22 belt
24 flat plate
26 aperature
28 belt slot

30 rigid member
32 fasteners
33 swivel means
34 belt
35 stop
36 adjustment means
38 grab position
40 middle bar
42 slidable member
43 aperture
44 waist belt
46 means for connection
48 means for fastening

DESCRIPTION OF THE PREFERRED EMBODIMENT(S)

Figures 2, 3:
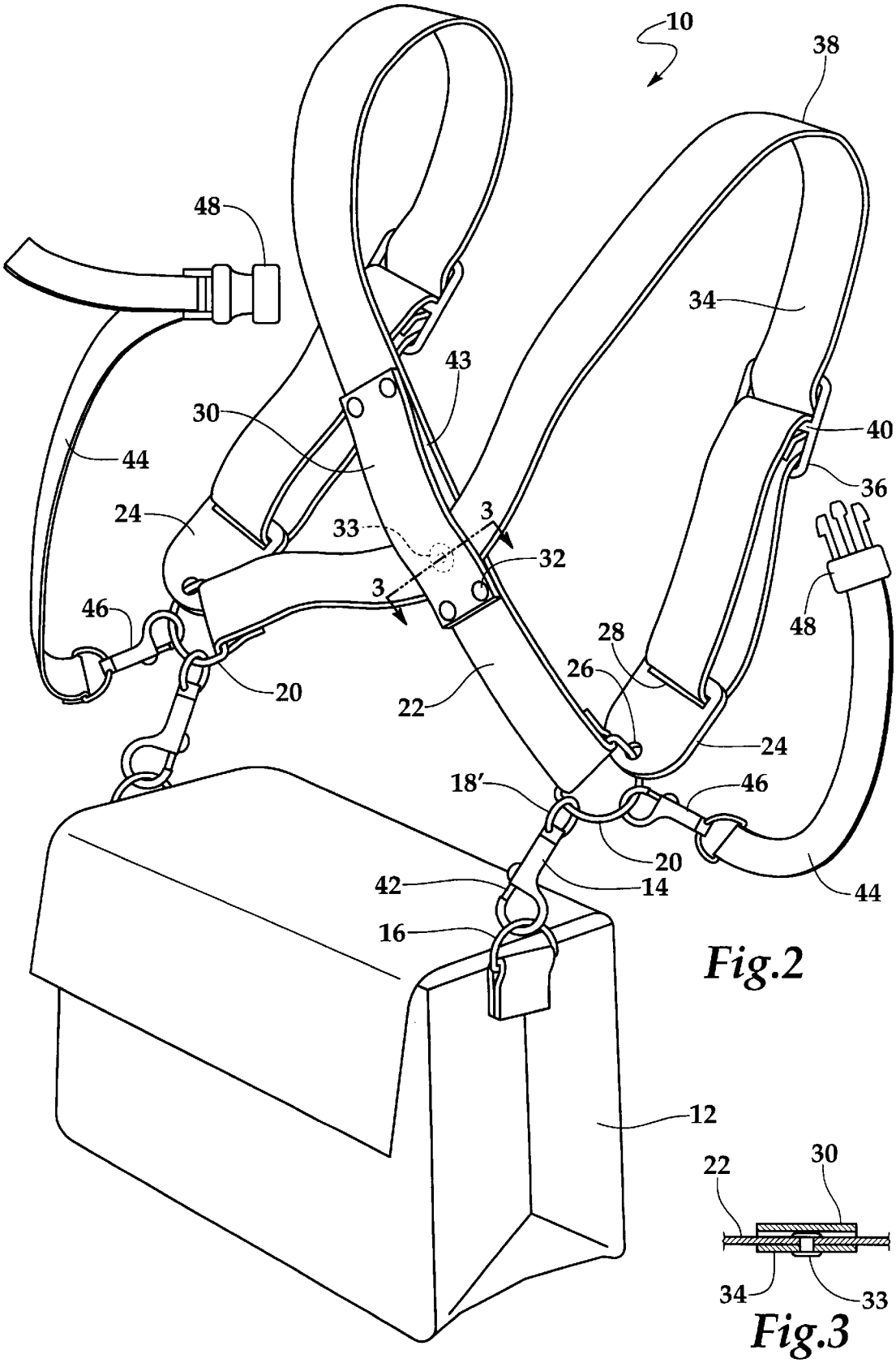
FIG. 2 is a perspective view of one embodiment of the present invention.
FIG. 3 is a cross-section taken from FIG. 2 as indicated.

Turning now descriptively to the drawing, in which FIGS. 1 through 3 illustrate the present invention being a strap system for converting a utility bag to a backpack.

Turning to FIG. 1, therein is shown a perspective view of a first embodiment of the present invention 10. Shown therein is the utility bag 12; i.e., a computer bag, having connected thereto the present invention 10 by use of a pair of clip means 14 which are in turn connected to a pair of connection means 16 on the bag 12. The clips 14 have a means for connection on the opposite end of the clip which are a fixed round loop 18 which are situated in a perpendicular plane to the clip member 14. Clip 14 is a safety clip having a spring loaded slidable member 42 which keeps the clip 14 secured in place. The fixed loop 18 is connected to a D loop 20 which is attached to one end of strap member 22 and having attached to the other end of strap 22 another fastener or plate 24. Plate 24 is a solid member having an aperture 26 therein for receiving the D loop 20 and having a slot 28 therein for a belt end which belt end is threaded through slot 28 and is then folded back upon itself and sewn in place. Belt 22 has a rigid member 30 attached thereto by means of fasteners 32. The rigid member 30 and the first belt 22 are formed contiguous to each other forming an aperture 43 therein through which the second belt member 34 passes. Belt member 34 has a stop 35 thereon, which positions the belt in relationship to the rigid member 30 in a pre-selected position. Also note that the pair of belts 22, 34 have conventional adjusting means being a length adjusting slide buckle 36 thereon through which the belts 22, 34 have their lengths adjusted. One strap is looped about the middle bar 40 of buckle 36 such that the buckle will slide along the strap. A grab position 38 is also shown on belt 34 which represents the point at which belt 34 is picked up by the hand of the user for placement across the back of the user.

In operation, when the first embodiment of the present invention 10 is to be placed on the back of the user, the user faces toward the straps and picks up strap 34 with his right hand at grab position 38 (production models will have the trademark of the present invention located at position 38 so that the user can easily know where to grab) and lifts upwardly which causes the rigid member 30 to slide downwardly along strap 34 toward D loop 20 on strap 34; the user then puts his right arm and shoulder through strap 34 in the conventional manner and then puts his other arm through strap 22 in the conventional manner which then places the backpack centrally across the back of the user as the user shoulders the present invention. It is important that the clips 14 be installed on the bag ring 16 so that the clip member 42 face the bag when the bag rings 16 are in their upright position. This is important because when one picks up the present invention 10, it falls into the correct position when the clips 14 are facing each other. Also note that it is important that the fixed loop 18 and D loop 20 have the correct alignment relationship so that the straps do not become twisted.

Turning to FIG. 2, therein is shown a perspective view of a second embodiment of the present invention 10. Shown therein is the utility bag 12; i.e., a computer bag, having connected thereto the present invention 10 by use of a pair of clip means 14 which are in turn connected to a pair of connection means 16 on the bag 12. The clips 14 have a means for connection on the opposite end of the clip which is a swiveling round loop 18, which, unlike the first embodiment shown in FIG. 1, does not have to be situated in a perpendicular plane to the clip member 14. Clip 14 is a safety clip having a spring loaded slidable member 42 which keeps the clip 14 secured in place. The swivel loop 18 is connected to a D loop 20 which is attached to one end of strap member 22 and having attached to the other end of strap 22 another fastener or plate 24. Plate 24 is a solid member having an aperture 26 therein for receiving the D loop 20 and having a slot 28 therein for a belt end which belt end is threaded through slot 28 and is then folded back upon itself and sewn in place. Belt 22 has a rigid member 30 attached thereto by means of fasteners 32. The rigid member 30 and the first belt 22 are formed contiguous to each other forming an aperture 43 therein through which the second belt member 34 passes with belts 22 and 34 being connected by a swivel connection 33 (see FIG. 3 for details). Also note that the pair of belts 22, 34 have conventional adjusting means being a length adjusting slide buckle 36 thereon through which the belts 22, 34 have their lengths adjusted. One strap is looped about the middle bar 40 of buckle 36 such that the buckle will slide along the strap. A grab position 38 is also shown on belt 34 which represents the point at which belt 34 is picked up by the hand of the user for placement across the back of the user. Also shown is a two-piece belt 44 to be worn about the waist of the user having means 46 for connection to the D-ring 20 or other suitable point and means 48 for fastening the two ends of the belt together.

In operation, when the second embodiment of the present invention 10 is to be placed on the back of the user, the user faces toward the straps and picks up strap 34 with his right hand at grab position 38 (production models will have the trademark of the present invention located at position 38 so that the user can easily know where to grab) and lifts upwardly which causes the rigid member 30, which acts as a cantilever-like member, to rotate downwardly about swivel means 33 to a generally horizontal position which creates a loop-like opening in strap 22; the user then puts his right arm and shoulder through strap 34 in the conventional manner and then puts his other arm through the loop created in strap 22 by the cantilever-like action of rigid member 30 in the conventional manner which then places the backpack centrally across the back of the user as the user shoulders the present invention. The swivel means 33 is positioned at a point on belt 22 about 25.8 percent of the total length of the belt as measured from the D-ring 20 on belt 22 with the total length of belt 22 being about 46.5 inches. The swivel means 33 is positioned at a point on belt 34 about 23.7 percent of the total length of the belt as measured from the D-ring 20 on belt 34 with the total length of belt 34 being about 46.5 inches. The rigid member 30 is positioned beginning from about 21.5 percent and extending to about 38.7 percent of the total length of the belt 22 as measured from the D-ring 20 on belt 22 with the total length of belt 22 being about 46.5 inches. The center of the grab position 38 is located about 55.9 percent from the D-ring 20 on belt 34 with the total length of belt 34 being about 46.5 inches. It is believed that the location of the swivel means 33, rigid member 30, and the grab position 38 provide optimum device performance when located as described above.

Turning to FIG. 3, therein is shown a cross-section taken from FIG. 2 as shown. Shown therein are straps 22, 34, rigid member 30, and swivel means 33 which passes through and pivotally connects straps 22, 34. Member 33 may be a brad-like member.

I claim:

1. An apparatus for converting a utility bag having at least a pair of attachment means thereon into a backpack, comprising:

a) a first strap having a D-shaped ring disposed on a first end and a flat plate having an aperture therein disposed on a second end, said flat plate having a slot therein for receiving said first strap;

b) a rigid member disposed on said first strap, having an aperture formed therein between said rigid member and said first strap;

c) a second strap having a D-shaped ring disposed on a first end and a flat plate having an aperture therein disposed on a second end, said flat plate having a slot therein for receiving said second strap;

d) a stop means disposed on said second strap whereby said second belt abuts to said rigid member of said first strap;

e) said D-shaped ring of said first end of said second strap passes through said aperture of said flat plate of said second end of said first strap;

f) said D-shaped ring of said first end of said first strap passes through said aperture of said flat plate of said second end of said second strap;

g) a first means for connecting said D-shaped ring disposed on said first end of said first strap to a first one of the attachment means of the utility bag; and, h) a second means for connecting said D-shaped ring disposed on said first end of said second strap to a second one of the attachment means of the utility bag wherein said stop means positions said second strap in relationship to said rigid member disposed on said first strap.

2. The apparatus of claim 1, further comprising means for adjusting the length of said first strap and said second strap.

3. The apparatus of claim 1, further comprising multiple fasteners for attaching said rigid member to said first strap.

4. The apparatus of claim 1, said first and second means for connecting further comprises a safety clip on a first end of each of said first and second means for connecting, each said safety clip for respective connection to the attachment means of the utility bag.

5. The apparatus of claim 4, each said first and second means for connecting further comprises a fixedly attached circular ring on a second end of said first and second means for connecting, said circular ring for respective connection to said D-shaped ring of said first strap and said second strap.

6. The apparatus of claim 5, wherein said circular ring lies in a plane perpendicular to said safety clip.

7. The apparatus of claim 2, said means for adjusting further comprising a length adjusting slide buckle.

8. An apparatus for converting a utility bag having at least a pair of attachment means thereon into a backpack, comprising:

a) a first strap having a D-shaped ring disposed on a first end and a flat plate having an aperture therein disposed on a second end, said flat plate having a slot therein for receiving said first strap;

b) a rigid member disposed on said first strap, having an aperture formed therein between said rigid member and said first strap;

c) a second strap having a D-shaped ring disposed on a first end and a flat plate having an aperture therein disposed on a second end, said flat plate having a slot therein for receiving said second strap;

d) a swivelable connection means connecting said first strap to said second strap, said swivelable connection means disposed adjacent said rigid member;

e) said D-shaped ring of said first end of said second strap passes through said aperture of said flat plate of said second end of said first strap;

f) said D-shaped ring of said first end of said first strap passes through said aperture of said flat plate of said second end of said second strap;

g) a first means for connecting said D-shaped ring disposed on said first end of said first strap to a first one of the attachment means of the utility bag; and, h) a second means for connecting said D-shaped ring disposed on said first end of said second strap to a second one of the attachment means of the utility bag wherein said swivelable connection means positions said second strap in relationship to said first strap.

9. The apparatus of claim 8, further comprising means for adjusting the length of said first strap and said second strap.

10. The apparatus of claim 8, further comprising multiple fasteners for attaching said rigid member to said first strap.

11. The apparatus of claim 8, said first and second means for connecting further comprises a safety clip on a first end of each of said first and second means for connecting, each said safety clip for respective connection to the attachment means of the utility bag.

12. The apparatus of claim 11, each said first and second means for connecting further comprises a swivelably attached circular ring on a second end of said first and second means for connecting, said circular ring for respective connection to said D-shaped ring of said first strap and said second strap.

13. The apparatus of claim 9, said means for adjusting further comprising a length adjusting slide buckle.

14. The apparatus of claim 8, further comprising a waist belt for connecting the apparatus about the waist of the user.

15. The apparatus of claim 8, wherein said swivelable connection means is disposed on said first strap at a point located at about 25.8 percent of the total length of said first strap as measured from said D-shaped ring disposed on said first strap.

16. The apparatus of claim 8, wherein said swivelable connection means is disposed on said second strap at a point located at about 23.7 percent of the total length of said second strap as measured from said D-shaped ring disposed on said second strap.

17. The apparatus of claim 8, wherein said rigid member is disposed on said first strap at a point beginning at about 21.5 percent and extending to about 38.7 percent of the total length of said first strap as measured from said D-shaped ring disposed on said first strap.

18. The apparatus of claim 8, said second strap further comprising a grab position, said grab position being disposed on said second strap at a point located at about 55.9 percent of the total length of said second strap as measured from said D-shaped ring disposed on said second strap.

* * * * *